United States Patent [19]

McClaflin

[11] 4,333,488

[45] Jun. 8, 1982

[54] METHOD OF TRANSPORTING VISCOUS HYDROCARBONS

[75] Inventor: Gifford G. McClaflin, Ponca City, Okla.

[73] Assignee: Conoco Inc., Ponca City, Okla.

[21] Appl. No.: 184,826

[22] Filed: Sep. 8, 1980

[51] Int. Cl.[3] ..... F17D 1/17

[52] U.S. Cl. ..... 137/13; 252/8.55 R; 252/312

[58] Field of Search ..... 141/1; 137/2, 3, 13; 252/8, 3, 8.55 R, 312

[56] References Cited

U.S. PATENT DOCUMENTS

| | | | |
|---|---|---|---|
| 2,674,619 | 4/1954 | Lundsted | 252/357 X |
| 3,309,308 | 3/1967 | Schad | 137/3 |
| 3,380,531 | 4/1968 | McAuliffe et al. | 137/13 X |
| 3,491,835 | 1/1970 | Gagle | 137/13 X |
| 3,734,111 | 5/1973 | McClintock | 137/3 |
| 3,850,206 | 11/1974 | Canevari et al. | 141/1 |
| 4,246,919 | 1/1981 | McClaflin | 137/13 |
| 4,246,920 | 1/1981 | McClaflin | 137/13 |
| 4,265,264 | 5/1981 | Sifferman | 252/8.55 X |
| 4,285,356 | 8/1981 | Sifferman | 137/13 |

*Primary Examiner*—Herbert B. Guynn

*Attorney, Agent, or Firm*—Bayless E. Rutherford, Jr.

[57] ABSTRACT

An improvement in the method of transporting viscous hydrocarbons through pipes is disclosed. Briefly, the improvement comprises adding water containing an effective amount of the adipate ester of a certain polyoxyethylene-polyoxypropylene block polymers. The method is especially useful when co-produced "hard" water is used. The resulting oil-in-water emulsion has a lower viscosity and is more easily transported.

7 Claims, No Drawings

METHOD OF TRANSPORTING VISCOUS HYDROCARBONS

BACKGROUND OF THE INVENTION

Field of the Invention

The invention is in the general field of improved methods of transporting viscous hydrocarbons through a pipe, such as a well-bore or a pipeline.

General Background

The movement of heavy crudes through pipes is difficult because of their high viscosity and resulting low mobility. One method of improving the movement of these heavy crudes has included adding to the crude lighter hydrocarbons (e.g. kerosine distillate). This reduces the viscosity and thereby improves the mobility. This method has the disadvantage that it is expensive and the kerosine distillate is becoming difficult to obtain.

Another method of improving the movement of these heavy crudes is by heating them. This requires the installation of expensive heating equipment and thus is an expensive process.

The use of oil-in-water emulsions, which use surfactants to form the emulsion, is known in the art.

Commonly assigned, copending application Ser. No. 35,561, filed May 3, 1979, now U.S. Pat. No. 4,265,264, is directed to a method which uses an oil-in-water emulsion which contains an effective amount of a combination of (a) a sodium or ammonium salt of an ethoxylated alcohol sulfate and certain polyoxyethylene-polyoxypropylene block polymers.

I have discovered a method of transporting viscous hydrocarbon which comprises adding water containing an effective amount of the adipate ester of certain polyoxyethylene-polyoxypropylene block polymers.

In this connection it should be noted neither the maleic ester nor the phosphoric ester of these block polymers are effective in this method.

BRIEF SUMMARY OF THE INVENTION

Briefly stated, the present invention is directed to an improved method of transporting viscous hydrocarbons through pipes wherein the improvement comprises forming an oil-in-water emulsion by adding to said hydrocarbon from about 20 to about 80 volume percent water containing an effective amount of the adipate ester of certain polyoxyethylene-polyoxypropylene block polymers.

In one embodiment the water used is a hard water.

DETAILED DESCRIPTION

Insofar as is known my method is suitable for use with any viscous crude oil. It is well known that crude oils often contain a minor amount of water.

The amount of water which is added to the hydrocarbon is suitably in the range of about 20 to about 80 volume percent based on the hydrocarbon. A preferred amount of water is in the range of about 30 to 60 volume percent. The water can be pure or can have a relatively high amount of dissolved solids. An advantage of my method is that it is particularly useful in "hard" water, i.e. water having relatively large amounts of so-called "hardness" cations, e.g. Mg and Ca. As used herein the term "hard" water refers to water containing at least above 500 parts per million of Mg and Ca cations. In addition to the hardness cations, the water can contain substantial amounts of other dissolved solids, e.g. NaCl.

My method uses the adipate ester of certain polyoxyethylene-polyoxypropylene block polymers. The term adipate ester refers to full esters, half esters and combinations thereof.

Polyoxyethylene-polyoxypropylene block polymers which are used to prepare the adipate esters are represented by the formula $$HO(CH_2CH_2O)_a(\underset{\underset{CH_3}{|}}{C}HCH_2O)_b(CH_2CH_2O)_cH$$

wherein a and c are numbers in the range of about 5 to about 20, with the sum of a and c being in the range of about 10 to about 40 and b is a number in the range of about 16 to about 30; preferably, a and c are in the range of about 10 to about 15, with the sum of a and c being in the range of about 20 to about 30 and b is in the range of about 20 to about 26.

A particularly suitable material is the adipate ester of "Pluronic" L-44, which is available from Wyandotte Chemicals Corporation.

Suitable and preferred amounts of the adipate ester of the block polymers, based on the hydrocarbon, is shown below.

| | (parts per million) by weight | |
|---|---|---|
| | Suitable | Preferred |
| Adipate ester of block polymers | 100–3,000 | 200–1,000 |

In order to illustrate the nature of the present invention still more clearly the following examples both illustrative and comparative, will be given. It is to be understood, however, that the invention is not to be limited to the specific conditions or details set forth in these examples except insofar as such limitations are specified in the appended claims.

The following materials were used in the tests described herein:

Crude Oil: Loco lease crude from Loco field, Stephens County, Oklahoma.

Water: Co-produced water from Loco field (~12,000 ppm total solids including about 600 ppm of Ca and about 130 ppm of Mg cations).

The materials tested will be described in each test.

Viscosities were determined using a Brookfield viscometer, Model LV with No. 1 Spindle.

The test procedure was as follows.

Test Procedure

Crude oil (300 ml) was poured into a Waring blender jar and stirred until homogeneous. Brookfield viscometer spindle was placed in the crude oil and viscosity is determined. This was done at rpm's of 6, 12, 30, and 60, then back down 30, 12, and 6. The reading on the dial was recorded for each speed (rpm). The viscometer stirrer was removed, and the oil was stirred again. Water (300 ml) was added to the crude and the mixture stirred until homogeneous, at which time the viscosity was read and recorded. In a separate step, the crude oil used initially was stirred until homogeneous and while stirring 300 ml of water containing 0.15 g (500 ppm based on crude oil) of the material tested was added and the mixture stirred until homogeneous, at which time the viscosity was read and recorded.

EXAMPLE 1

This example is illustrative and shows the viscosity improvement obtained using 500 ppm of the adipate ester of a polyoxyethylene-polyoxypropylene block polymer wherein, in the polymer a and c are 9.1 each and b is 20.7. The viscosity values for the solution, the crude alone and a 50/50 mixture of crude and water are shown in Table I.

TABLE I

| RPM | Crude Alone Viscosity, cp | Crude plus Water 50/50 Ratio Viscosity, cp | Crude plus 300 ml Water Containing 500 ppm of the Described Ester Viscosity, cp |
|---|---|---|---|
| 6 | 330 | 450 | 40 |
| 12 | 334 | 435 | 100 |
| 30 | O.S. | — | 92 |
| 60 | O.S. | — | 79.5 |
| 30 | O.S. | — | 107 |
| 12 | 345 | 425 | 152.5 |
| 6 | 340 | 440 | 193 |

Test Temperature = 21° C.
O.S. = Offscale

EXAMPLE 2

This example is comparative and shows the viscosity values obtained using water containing 500 ppm of the maleic ester of the polyoxyethylene-polyoxypropylene block polymers of Example 1.

The viscosity values for the solution containing the maleic ester, are shown in Table II.

EXAMPLE 3

This example is comparative and shows the viscosity values obtained using water containing 500 ppm of the phosphate ester of the polyoxyethylene-polyoxypropylene block polymer of Example 1.

The viscosity values for the solution containing the phosphate ester are shown in Table II.

TABLE II

| RPM | Crude Plus 300 ml Water Containing 500 ppm of the Described Maleic Ester Viscosity, cp | Crude Plus 300 ml Water Containing 500 ppm of the Described Phosphate Ester Viscosity, cp |
|---|---|---|
| 6 | 220 | 298 |
| 12 | 210 | 284 |
| 30 | O.S. | O.S. |
| 60 | O.S. | O.S. |
| 30 | O.S. | O.S. |
| 12 | 225 | 290 |
| 6 | 223 | 282 |

Test Temperature = 21° C.
O.S. = Offscale

EXAMPLE 4

Tests are run on the adipate ester of other polyoxyethylene-polyoxypropylene block polymers. In these polymers a, b, and c had the following values.

| | a | b | c |
|---|---|---|---|
| Polymer A | 11 | 25 | 11 |
| Polymer B | 13 | 30 | 13 |
| Polymer C | 14 | 21 | 14 |

Use at a level of 500 ppm in 50/50 water/crude oil provides a reduction in the viscosity of the resulting oil-in-water emulsion.

Thus, having described the invention in detail, it will be understood by those skilled in the art that certain variations and modifications may be made without departing from the spirit and scope of the invention as defined herein and in the appended claims.

I claim:

1. In the method of transporting a viscous hydrocarbon through a pipe the improvement which comprises forming an oil-in-water emulsion of lower viscosity to facilitate transporting said hydrocarbon through said pipe by adding to said hydrocarbon from about 20 to about 80 volume percent of an aqueous solution containing an effective amount, in the range of about 100 to about 3,000 parts per million by weight, based on said hydrocarbon of the adipate ester of a polyoxyethylene-polyoxypropylene block polymer, which is represented by the formula $$HO(CH_2CH_2O)_a(\underset{\underset{CH_3}{|}}{CH}CH_2O)_b(CH_2CH_2O)_cH$$

wherein a and c are numbers in the range of about 5 to about 20, with the sum of a and c being in the range of about 10 to about 40 and b is a number in the range of about 16 to about 30.

2. The method of claim 1 wherein the hydrocarbon is a crude oil.

3. The method of claim 1 wherein the amount of aqueous solution, added to said hydrocarbon, is about 30 to about 60 volume percent.

4. The method of claim 3 wherein the amount of adipate ester of polyoxyethylene-polyoxypropylene block polymer is in the range of about 200 to about 1,000 parts per million.

5. The method of claim 4 wherein, in the block polymer a and c are numbers in the range of about 10 to about 15, with the sum of a and c being in the range of about 20 to about 30 and b is a number in the range of about 16 to about 30.

6. The method of claims 3, 4, or 5, wherein the hydrocarbon is crude oil.

7. The method of claim 2 wherein:

(a) the amount of aqueous solution, added to said crude oil, is about 50 volume percent, (b) the amount of said adipate ester is about 500 parts per million, and (c) in the block polymer moiety of said ester a and c are 9.1 each and b is 20.7.

* * * * *